US006415888B2

(12) United States Patent
An et al.

(10) Patent No.: US 6,415,888 B2
(45) Date of Patent: Jul. 9, 2002

(54) MUFFLER

(75) Inventors: Kwang Hyup An, Seoul; Hwan Joo Myung, Gwangmyung; In Seop Lee, Seoul, all of (KR)

(73) Assignee: LG Electronics Inc., Seoul (KR)

( * ) Notice: Subject to any disclaimer, the term of this patent is extended or adjusted under 35 U.S.C. 154(b) by 16 days.

(21) Appl. No.: 09/737,935

(22) Filed: Dec. 18, 2000

(30) Foreign Application Priority Data

Jun. 12, 2000 (KR) ..... 2000-32153

(51) Int. Cl.[7] ..... F01N 1/00
(52) U.S. Cl. ..... 181/281; 181/229; 181/249
(58) Field of Search ..... 181/229, 249, 181/280, 255, 403; 417/312, 902

(56) References Cited

U.S. PATENT DOCUMENTS 4,693,339 A * 9/1987 Beale et al. ..... 181/229
5,957,664 A * 9/1999 Stolz et al. ..... 417/312
5,979,598 A * 11/1999 Wolf et al. ..... 181/249
6,009,705 A * 1/2000 Arnott et al. ..... 123/184.57
6,158,214 A * 12/2000 Kempka et al. ..... 181/212

* cited by examiner

*Primary Examiner*—Robert E. Nappi
*Assistant Examiner*—Kim Lockett
(74) *Attorney, Agent, or Firm*—Birch, Stewart, Kolasch & Birch, LLP

(57) ABSTRACT

Disclosed is a muffler in which a helicoil member is installed in each conduit, through which refrigerant gas flows from or into an expansion chamber during reciprocating movements of a piston in a cylinder. The helicoil member has diverse twisted angles and diverse twisted shapes, and serves to divide pulsation of noise, generated during the reciprocating movements of the piston, into pulsation of different phases, and then to merge the divided pulsation together, while allowing the refrigerant gas to have the form of a vortex flow. As pulsation of noise generated during an operation of sucking refrigerant gas pass along different travel paths defined by the helicoil member, a mutual interference occurs between the pulsation respectively emerging from the travel paths of the helicoil member. Therefore, an increased offset effect for the pulsation of noise is obtained, which maximizes a noise attenuation effect. It is also possible to prevent refrigerant gas from flowing reversal due to a counter pressure gradient occurring during the reciprocating movements of the piston. Accordingly, enhanced compressor efficiency is obtained.

8 Claims, 8 Drawing Sheets

MUFFLER

BACKGROUND OF THE INVENTION

1. Field of the Invention

The present invention relates to a muffler, and more particularly to a muffler used in a reciprocating compressor.

2. Description of the Conventional Art

Generally, mufflers applied to compressors are classified into a suction muffler connected to a fluid suction section of a compressor and a discharge muffler connected to a fluid discharge section of a compressor.

Such suction and discharge mufflers serve to attenuate a pulsation phenomenon periodically generated during repeated fluid suction and discharge operations of a compressor, to which those mufflers are applied, thereby allowing the compressor to smoothly suck and discharge fluid. These mufflers also serve to shield impact noise generated in opening and closing operations of a valve and noise resulting from flowing of fluid so that those noise cannot be externally transmitted from the compressor, thereby achieving a silent operation of the compressor.

FIG. 1 is a sectional view illustrating an example of a hermetic reciprocating compressor respectively provided with conventional mufflers at suction and discharge sections thereof.

As shown in FIG. 1, the reciprocating compressor includes a casing 1 filled with a desired amount of oil, an electric motor mechanism installed in a lower portion of the casing 1 in the interior of the casing 1 and adapted to generate a drive force in response to electric power externally applied thereto, and a compression mechanism installed at an upper portion of the casing 1 in the interior of the casing 1 and adapted to receive the drive force from the electric motor mechanism so as to conduct gas sucking and compressing operations.

The compression mechanism includes a frame 2 fixedly mounted to the casing 1 in the interior of the casing 1, a cylinder 3 fixedly mounted to a portion of the frame 2, and a drive shaft 5 extending vertically through a central portion of the frame 2 while being fitted in a rotor 4B included in the electric motor mechanism so that it is coupled to the rotor 4B. The drive shaft 5 is provided at an upper end thereof with an eccentric portion. The compression mechanism also includes a connecting rod 6 coupled to the eccentric portion of the drive shaft 5 and adapted to convert a rotating movement into a reciprocating movement, a piston 7 connected to the connecting rod 6 and slidably received in the cylinder 3 in such a fashion that it reciprocates in the cylinder 3, a valve assembly 8 coupled to the cylinder 3 and adapted to control suction and discharge of refrigerant gas, and a head cover 9 coupled to the valve assembly 8 and defined with a desired discharge space. The compression mechanism further includes a suction muffler 10 coupled to a portion of the head cover in such a fashion that it communicates with a suction inlet of the valve assembly 8, and a discharge muffler DM mounted to the cylinder 3 in such a fashion that it communicates with a discharge outlet of the valve assembly 8.

In association with respective orientations of the above-mentioned elements, the upward direction corresponds to the direction toward the upper portion of the plane in FIG. 1.

As shown in FIG. 2, the muffler 10 is provided with a muffler inlet 11 directly communicated with a refrigerant line SP extending through the casing 1 or arranged in the interior of the casing 1.

The muffler inlet 11 communicates with a first reservoir S1 defined, in the form of an expansion chamber, in a central portion of the muffler 10.

The first reservoir S1 communicates with a second reservoir S2 defined, in the form of an expansion chamber, beneath the first reservoir S1 via a first conduit having a small cross-sectional area. A third reservoir S3 is defined, in the form of an expansion chamber, above the first reservoir S1. The third reservoir S3 serves as the Helmholtz reservoir.

The second reservoir S2 communicates with a muffler outlet 12 communicating with the valve assembly 8 via a second conduit 16 extending vertically into the second reservoir S2 through the third reservoir S3.

A resonant aperture 17 is formed at an upper portion of the second conduit 16 arranged in the third reservoir S3 so that it constitutes the Helmholtz Resonator, together with the third reservoir S3.

In FIGS. 1 and 2, the reference numeral or character 4A denotes a stator, 18 an oil discharge port, C a support spring, and O an oil feeder. In addition, the reference numerals 13 and 14 denote partition walls, respectively.

Now, an operation of the hermetic reciprocating compressor provided with the above mentioned conventional mufflers will be described.

When the rotor 4A is rotated by a mutual electromagnetic force generated between the stator 4A and the rotor 4B in response to electric power applied to the electric motor mechanism, the drive shaft 5 rotates along with the rotor 4B. The rotation of the drive shaft 5 is converted into straight reciprocating movements by the connecting rod 6 coupled to the eccentric portion of the drive shaft 5. The reciprocating movements is transmitted to the piston 7 which, in turn, reciprocates in the interior of the cylinder 3 to compress refrigerant gas and to discharge the compressed refrigerant gas. Pressure pulsation and noise, which may be generated during the above-mentioned operations of the piston 7, flow in a direction opposite to the flowing direction of the refrigerant gas so that they are attenuated by the muffler 10.

The procedure for attenuating the pressure pulsation and flowing noise by the conventional mufflers will now be described.

During a stroke of the piston 7 from an upper dead point to a lower dead point, refrigerant gas filled in the second reservoir S2 is forced to be sucked into the interior of the cylinder 3, that is, a compression chamber, via the second conduit 16 and muffler outlet 12 while opening a suction valve of the valve assembly 8. Simultaneously, new refrigerant gas is introduced into the second reservoir S2 via the muffler inlet 11, first reservoir S1 and first conduit 15. On the other hand, during a stroke of the piston 7 from the lower dead point to the upper dead point, the suction valve of the valve assembly 8 is closed. In this state, a discharge valve of the valve assembly 8 is simultaneously opened. Therefore, compressed refrigerant gas is discharged into a discharge space DS defined in the head cover 9.

In the procedure in which the suction and discharge of refrigerant gas are repeated, a repetitive pressure pulsation occurs continuously in the muffler 10 and head cover 9. Such pressure pulsation is propagated to each flow path defined in the muffler 10. As this pressure pulsation passes the second conduit 16, second reservoir S2, first conduit 15, and first reservoir S1, they are gradually attenuated, and finally dissipated. Therefore, there is little pressure pulsation at the muffler inlet 11. Accordingly, the refrigerant gas can be smoothly introduced.

Meanwhile, noise generated during the suction of refrigerant gas is converted into heat energy in accordance with a diffusion and dissipation thereof occurring when it passes through the conduits 15 and 16, and reservoirs S1, S2 and S3, so that it is attenuated. In particular, noise of a specific frequency is attenuated by the helmholtz Resonator composed of the resonant aperture 17 of the second conduit 16 and the third reservoir S3.

In the above mentioned noise attenuation method, in which attenuation of noise is achieved using a simple resonation effect and the Helmholtz Resonator, however, it is necessary to use an excessively large volume for each reservoir. Therefore, there is a problem in that the whole muffler volume is undesirably increased.

Furthermore, the procedure of converting pulsation energy of noise into heat energy in accordance with a diffusion and dissipation causes an increase in muffler temperature resulting in an increase in the specific volume of refrigerant gas. Therefore, there is a problem in that the efficiency of the compressor is degraded.

The periodic pressure pulsation of the compression also causes a periodic pulsation of the internal muffler pressure resulting in a momentary counter pressure gradient serving to generate a reverse flow of refrigerant gas. Therefore, the introduction amount of refrigerant gas is reduced, thereby causing degradation in the efficiency of the compressor.

SUMMARY OF THE INVENTION

Therefore, an object of the invention is to provide a muffler capable of having a reduced volume while providing an improved muffling effect, and reducing a generation of heat energy.

Another object of the invention is to provide a muffler capable of avoiding the generation of a reverse flow of refrigerant gas resulting in a reduced introduction amount of refrigerant gas, thereby preventing a degradation in the efficiency of a compressor to which the muffler is applied.

In accordance with the present invention, these objects are accomplished by providing a muffler comprising: a muffler inlet arranged in the muffler body, the muffler inlet communicating a refrigerant line extending into the interior of the casing; a first reservoir defined, in the form of an expansion chamber, in the muffler body above the muffler inlet; a second reservoir defined, in the form of an expansion chamber, in the muffler body beneath the first reservoir; a first conduit having a reduced cross-sectional area, the first conduit serving to connect the first and second reservoirs to each other; a second conduit having a reduced cross-sectional area, the second conduit serving to communicate the second reservoir with a muffler outlet provided at the muffler body; a third reservoir defined, in the form of an expansion chamber, defined in the muffler body around the second conduit above the second reservoir, the third reservoir serving as the Helmholtz reservoir; and an interference member fixedly mounted in at least one of the first and second conduits.

DESCRIPTION OF THE PREFERRED EMBODIMENTS

Figure 1:
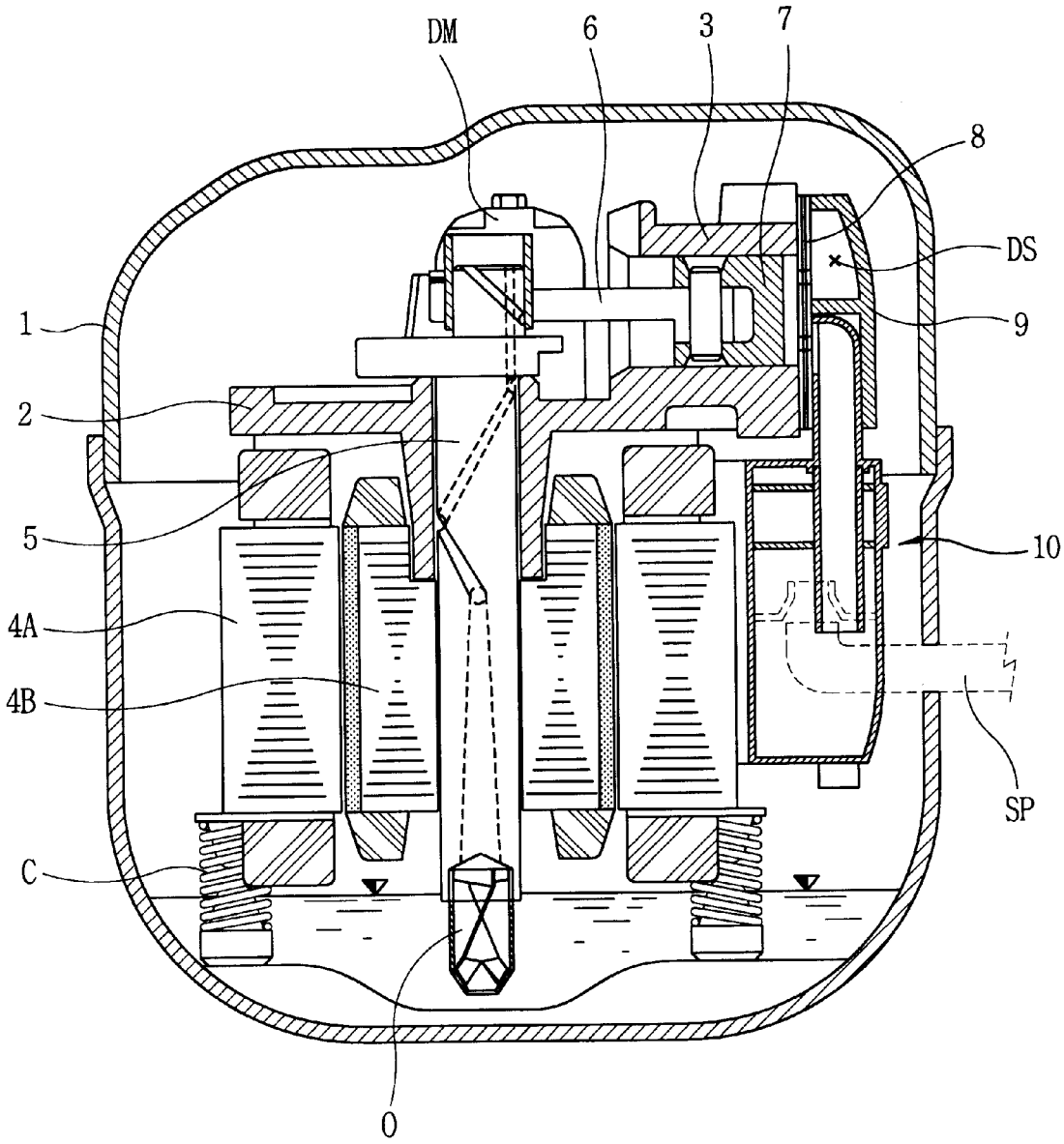
FIG. 1 CONVENTIONAL ART
FIG. 1 is a sectional view illustrating an example of a conventional hermetic reciprocating compressor.
Figure 2:
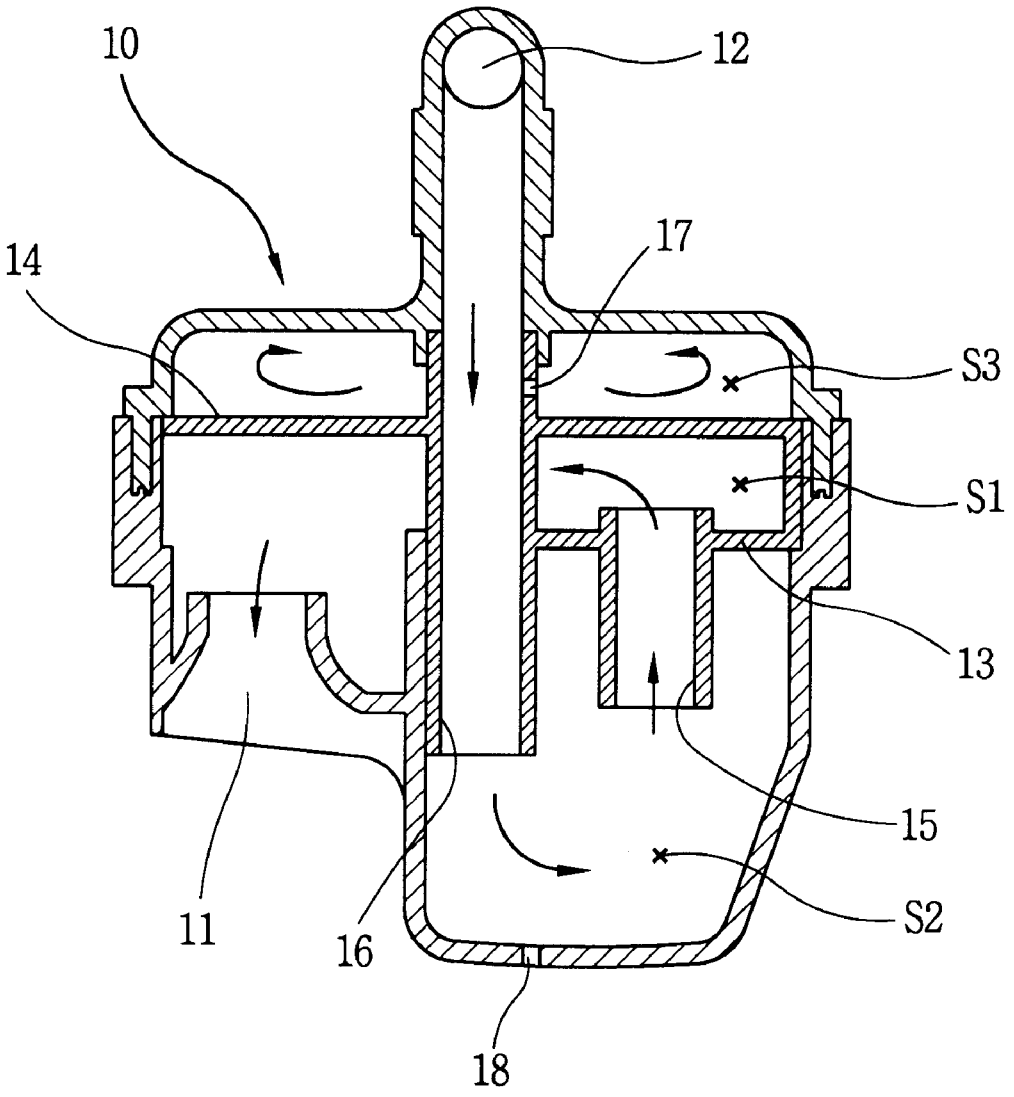
FIG. 2 CONVENTIONAL ART
FIG. 2 is a sectional view illustrating an example of a muffler mounted to a suction section of the conventional hermetic reciprocating compressor.

Hereinafter, a muffler according to the present invention will be described in detail, with reference to the annexed drawings illustrating an embodiment of the present invention.

In the drawings, the same elements as those of the conventional configuration are denoted by the same reference numerals, respectively. In addition, no description will be made in conjunction with the same configurations and operations as those of the conventional case.

Figure 3:
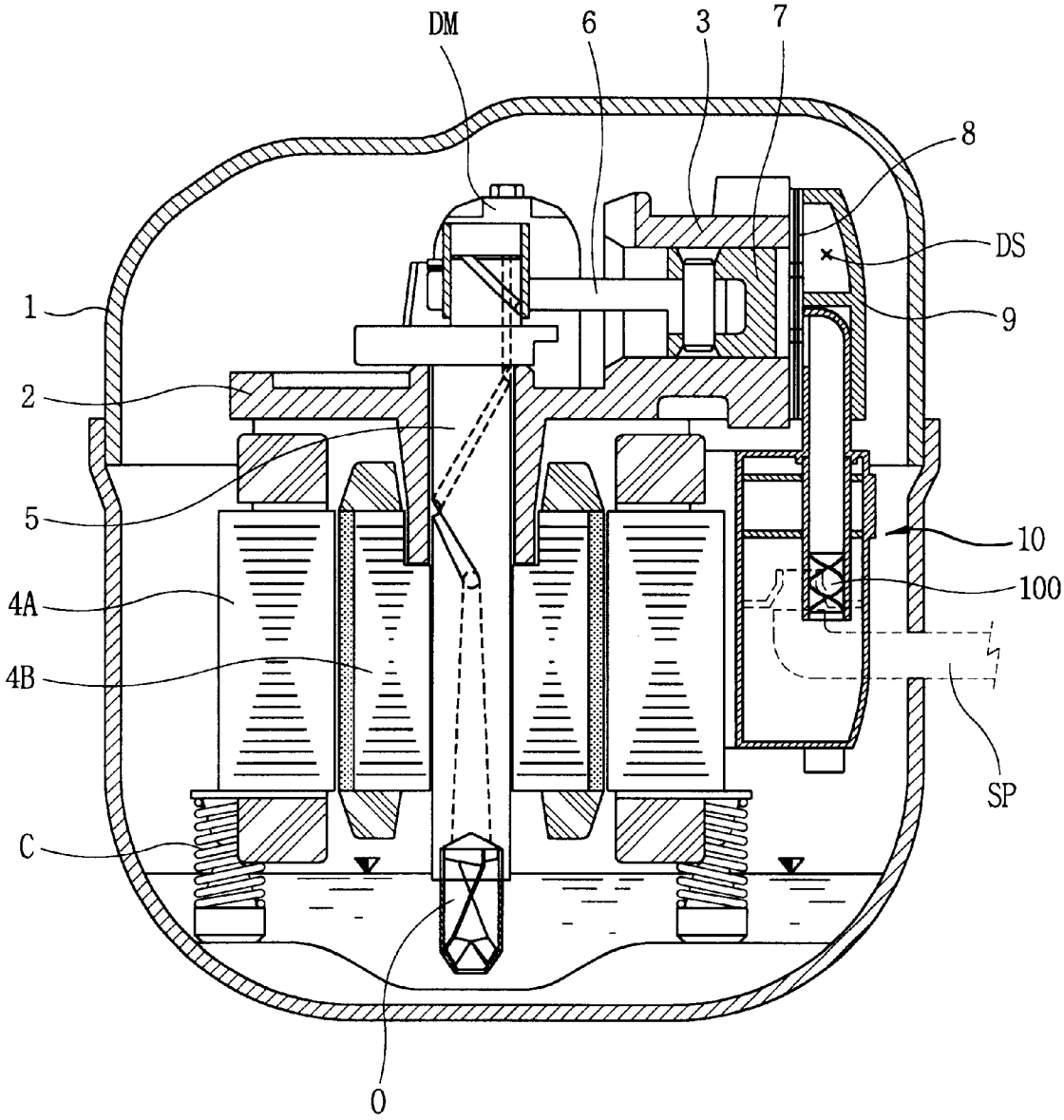
FIG. 3 is a sectional view illustrating an example of a hermetic reciprocating compressor provided with mufflers according to an embodiment of the present invention.

Referring to FIG. 3, a reciprocating compressor provided with the muffler of the present invention is illustrated. As shown in FIG. 3, the reciprocating compressor includes an electric motor mechanism fixedly mounted in a casing 1 and adapted to generate a drive force, and a compression mechanism connected to the electric motor mechanism by a drive shaft 5 and adapted to conduct sucking and compressing operations for refrigerant gas.

Figure 4:
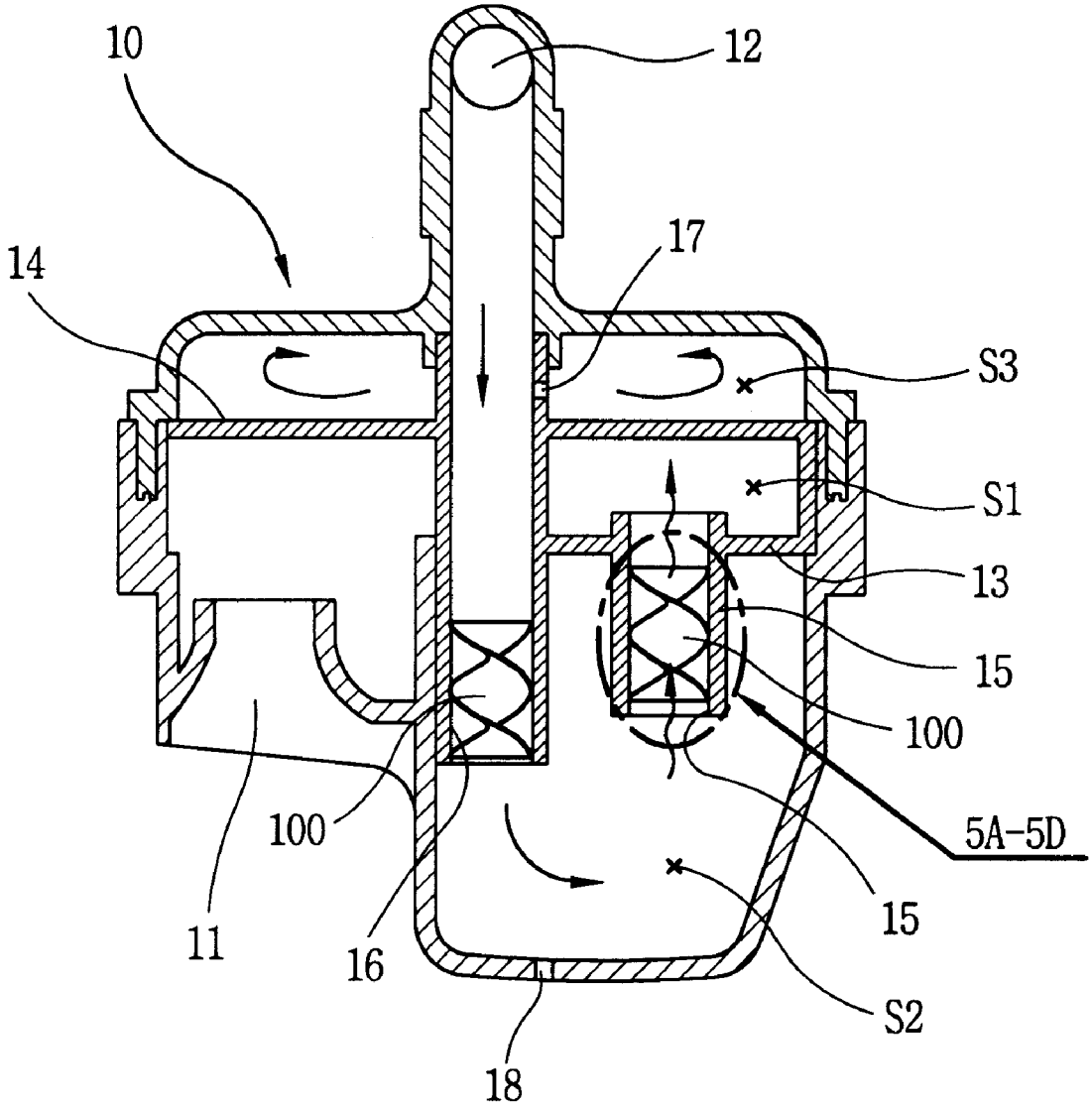
FIG. 4 is a sectional view illustrating the muffler of the present invention mounted to a suction section of the hermetic reciprocating compressor shown in FIG. 3.

As shown in FIG. 4, the muffler 10 is provided with a muffler inlet 11 directly communicated with a refrigerant line SP extending through the casing 1 or arranged in the interior of the casing 1.

The muffler inlet 11 communicates with a first reservoir S1 defined, in the form of an expansion chamber, in a central portion of the muffler 10.

The first reservoir S1 communicates with a second reservoir S2 defined, in the form of an expansion chamber, beneath the first reservoir S1 via a first conduit having a small cross-sectional area. A third reservoir S3 is defined, in the form of an expansion chamber, above the first reservoir S1. The third reservoir S3 serves as the Helmholtz reservoir.

The second reservoir S2 communicates with a muffler outlet 12 communicating with the valve assembly 8 via a second conduit 16 extending vertically into the second reservoir S2 through the third reservoir S3.

A resonant aperture 17 is formed at an upper portion of the second conduit 16 arranged in the third reservoir S3 so that it constitutes the Helmholtz Resonator, together with the third reservoir S3.

Helicoil members 100, each of which is made of a spiral foil, are fixedly mounted in the first and second conduits 15 and 16, respectively.

Hereinafter, the mounting of the helicoil members 100 will be described in detail.

Figure 5A:
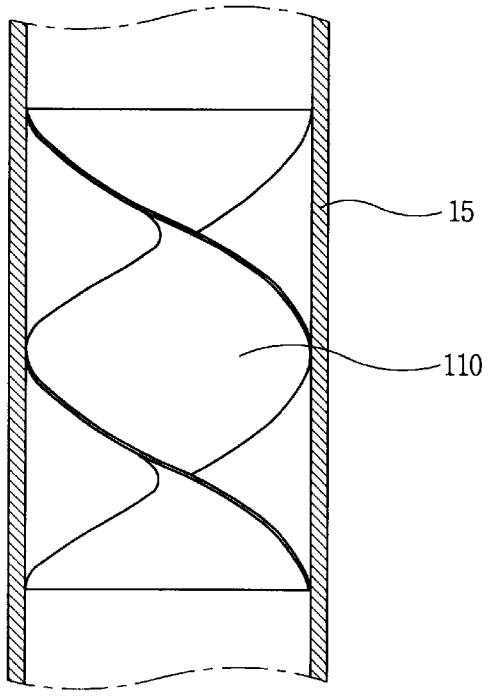
FIG. 5A is a sectional view corresponding to a portion 5A–5D of FIG. 4, illustrating a helicoil member according to an embodiment of the present invention.

In accordance with an embodiment shown in FIG. 5A, each helicoil member 100, which is fixedly mounted in an associated one of the first and second conduits 15 and 16, comprises a 360°-twisted helicoil foil 110 extending in a flowing direction of refrigerant gas while being twisted by an angle of 360° in a counter-clockwise direction when viewed on the plane of FIG. 5A.

Figure 5B:
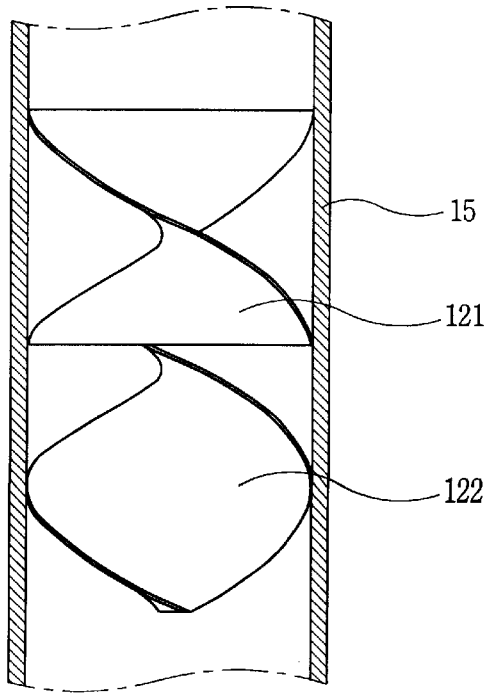
FIG. 5B is a sectional view corresponding to a portion 5A–5D of FIG. 4, illustrating a helicoil member according to another embodiment of the present invention.

Alternatively, each helicoil member 100 may comprise a plurality of alternating 180°-twisted helicoil foils 121 and 122 arranged one after another in the flowing direction of refrigerant gas in such a fashion that adjacent ones thereof cross each other at their facing ends to form an angle of 90° between those facing ends, as shown in FIG. 5B.

Figure 5C:
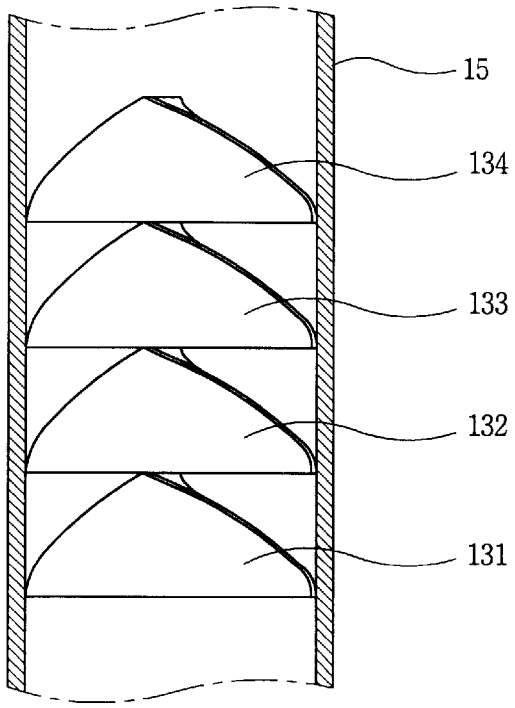
FIG. 5C is a sectional view corresponding to a portion 5A–5D of FIG. 4, illustrating a helicoil member according to another embodiment of the present invention.

In accordance with another embodiment shown in FIG. 5C, each helicoil member 100 comprises a plurality of 90°-twisted helicoil foils 131, 132, 133, and 134 arranged in parallel in the flowing direction of refrigerant gas.

Figure 5D:
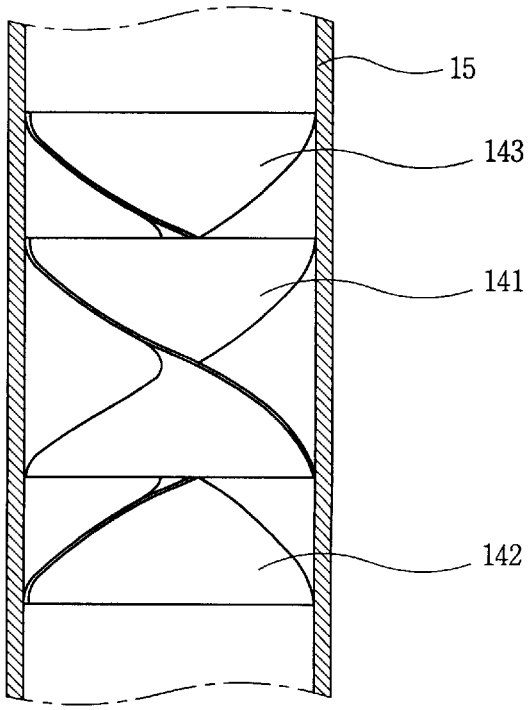
FIG. 5D is a sectional view corresponding to a portion 5A–5D of FIG. 4, illustrating a helicoil member according to another embodiment of the present invention.

In accordance with another embodiment shown in FIG. 5D, each helicoil member 100 comprises a 180°-twisted helicoil foil 141, and a pair of 90°-twisted helicoil foils 142 and 143 respectively arranged adjacent to opposite ends of the 180°-twisted helicoil foil 141 in the flowing direction of refrigerant gas in such a fashion that each of the 90°-twisted helicoil foils cross the 180°-twisted helicoil foil 141 at facing ends thereof to form an angle of 90° between those facing ends.

Of course, the configuration of each helicoil member 100 is not limited to the above mentioned embodiments. Each helicoil member 100 may be configured by other combinations of the above mentioned helicoil foils made to have diverse twisted angles, twisted lengths, and twisted directions, depending on the frequency characteristics of noise.

Each helicoil member 100 is preferably made of a micro-porous material so that it has a sound absorbing function by itself. However, such a micro-porous material is expensive. Taking this fact into consideration, the helicoil members 100 may be made of an inexpensive material such as a rubber material, plastic, or steel.

In FIGS. 3 and 4, the reference numeral or character 4A denotes a stator, 18 an oil discharge port, C a support spring, and O an oil feeder. In addition, the reference numerals 13 and 14 denote partition walls, respectively.

An operation of the hermetic reciprocating compressor provided with the above mentioned mufflers according to the present invention will now be described.

When electric power is applied to the electric motor mechanism, the piston 7 reciprocates straight movement, thereby conducting a compression of refrigerant gas and a discharge of the compressed refrigerant gas.

Hereinafter, the procedure for attenuating pressure pulsation and flowing noise by the muffler of the present invention will be described in detail.

During an expansion stroke of the piston 7 from an upper dead point to a lower dead point, a negative pressure is exerted in the interior of the cylinder 3, thereby causing a suction valve of the valve assembly 8 to be opened. As a result, refrigerant gas filled in the second reservoir S2 is sucked into the interior of the cylinder 3 via the muffler outlet 12 until the internal pressure of the cylinder corresponds to the pressure of the muffler 10. Simultaneously, the second reservoir S2 is replenished with new refrigerant gas fed via the first reservoir S1 and first conduit 15.

On the other hand, during a compression stroke of the piston 7 from the lower dead point to the upper dead point, the internal pressure of the cylinder 3 is gradually increased. When the internal pressure of the cylinder 3 is higher than the biasing force of the support spring C applied to the discharge valve of the valve assembly 8, the discharge valve is opened, thereby causing the high-pressure compressed refrigerant gas in the cylinder 3 to be discharged into a discharge space DS defined in the head cover 9.

At this time, noise generated during the suction of refrigerant gas is converted into heat energy in accordance with a diffusion and dissipation thereof occurring when it passes through the conduits 15 and 16, and reservoirs S1, S2 and S3, so that it is attenuated. In particular, noise of a specific frequency is attenuated by the helmholtz Resonator composed of the resonant aperture 17 of the second conduit 16 and the third reservoir S3.

Meanwhile, acoustic waves propagated from a noise source are propagated along two travel paths defined by each helicoil member 100, and then meet together at a downstream end of the helicoil member 100. Two acoustic waves emerging from respective travel paths have different phases, so that they interfere with each other. Therefore, the amplitudes of the acoustic waves are reduced. In accordance with this principle, refrigerant gas can flow without any considerable resistance in a state in which the level of noise is reduced.

Accordingly, the amount of heat energy generated in the reservoirs S1 and S2 is reduced, thereby decreasing the temperature of the muffler 10. This results in a reduction in the specific volume of refrigerant, thereby achieving an improvement in the efficiency of the compressor.

Where each helicoil member 100 is configured using a plurality of alternating 180°-twisted helicoil foils 121 and 122 arranged in such a fashion that adjacent ones thereof cross each other at their facing ends to form an angle of 90° between those facing ends, as shown in FIG. 5B, acoustic waves are first traveled along the upstream 180°-twisted helicoil foil 121 while being divided into two acoustic waves in a lateral directional when viewed on the drawing plane. These two acoustic waves emerging from the upstream 180°-twisted helicoil foil 121 primarily interfere with each other at the downstream end of the upstream 180°-twisted helicoil foil 121. The primarily-interfered acoustic waves are then traveled along the 180°-twisted helicoil foil 122 following the upstream 180°-twisted helicoil foil 121 while being divided into two acoustic waves in a vertical direction when viewed on the drawing plate. These two acoustic waves emerging from the 180°-twisted helicoil foil 122 secondarily interfere with each other at the downstream end of the 180°-twisted helicoil foil 122. Thus, an increased offset effect for acoustic waves is obtained.

Figure 6A:
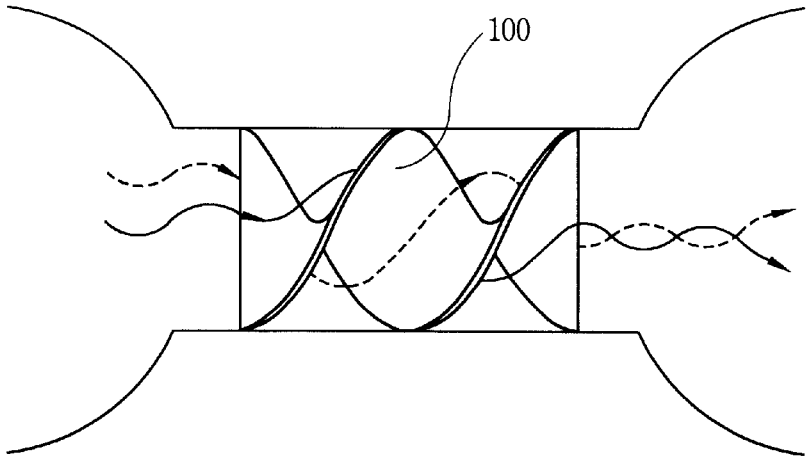
FIG. 6A is a schematic view illustrating a procedure in which acoustic waves interfere with each other in the muffler of the present invention.
Figure 6B:
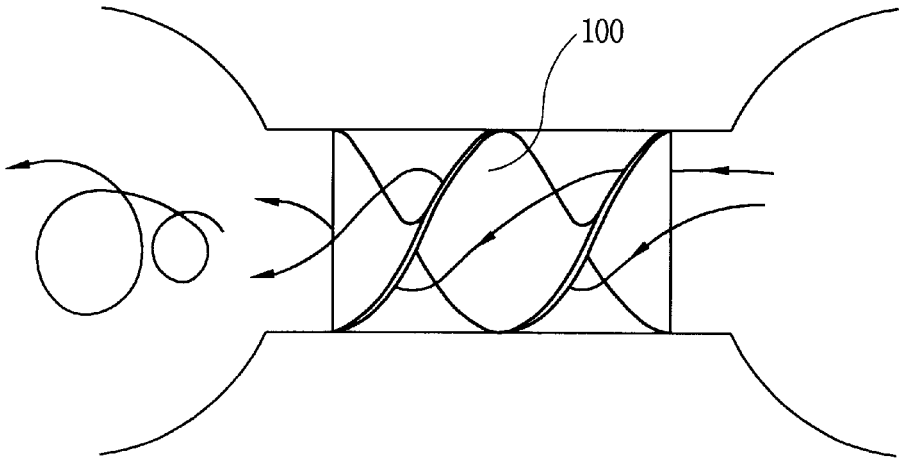
FIG. 6B is a schematic view illustrating a procedure in which refrigerant gas is sucked in the muffler of the present invention.

As shown in FIG. 6B, respective flows of refrigerant gas sucked from the second reservoir S2 toward the muffler outlet 12 and sucked from the first reservoir S1 into the second reservoir S2 during the expansion stroke of the piston 7 move along spiral flow paths defined by the helicoil members 100 respectively installed in the second conduit 16 and the first conduit 15. As a result, the refrigerant gas flows emerging from the helicoil members 100 have the form of a vortex flow having velocity components in an axial direction (that is, a direction parallel to the extending direction of the helicoil member) and strong velocity components in a circumferential direction. Accordingly, it is possible to prevent the refrigerant gas flows from flowing reversal during a compression stroke of the piston 7 following the expansion stroke, by virtue of the strong circumferential velocity components of the refrigerant gas flows, even when a so-called "counter pressure gradient" occurs due to a momentary stagnation (inertial force) of refrigerant gas.

Figure 7:
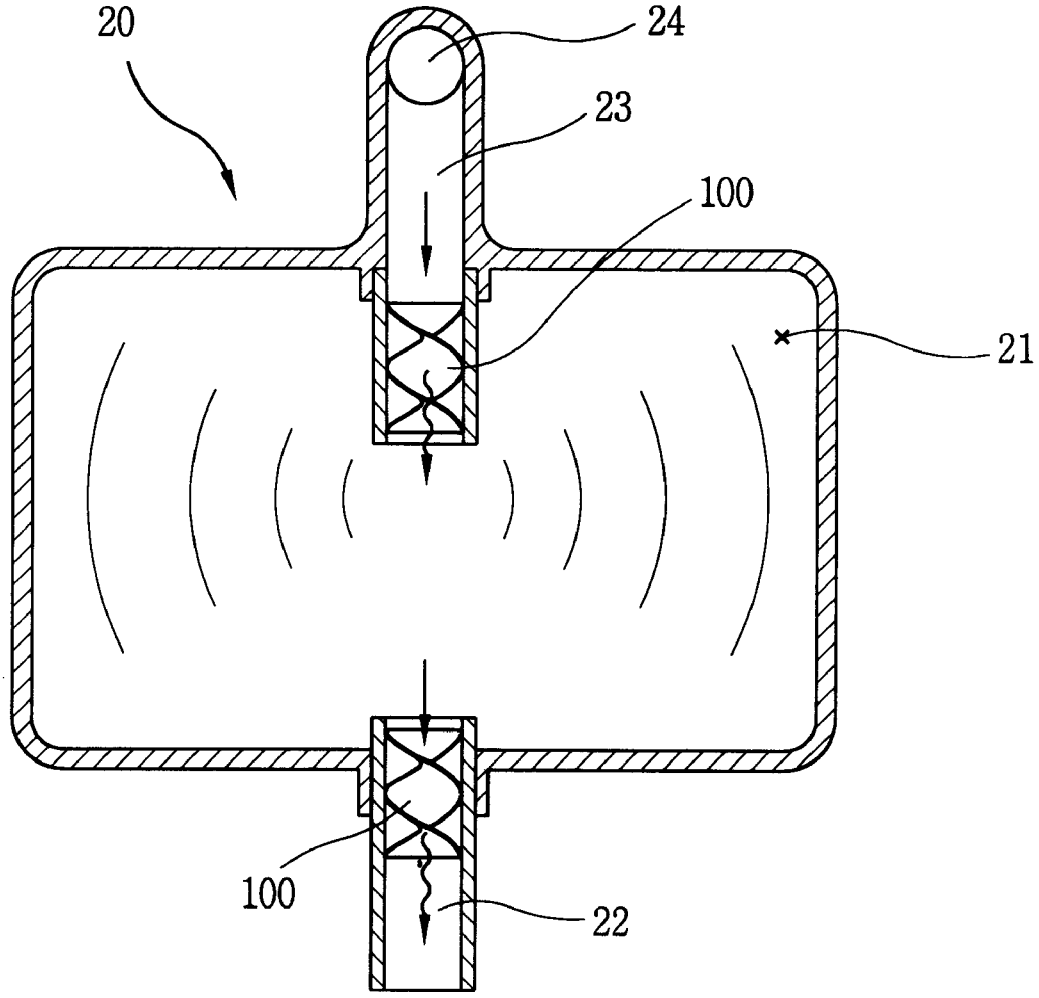
FIG. 7 is a sectional view illustrating a muffler according to another embodiment of the present invention.

Since the helicoil members 100 installed in the conduits 15 and 16 serve to provide improved effects of preventing a reverse flow of refrigerant gas and attenuating noise, the muffler of the present invention can exhibit effects similar to those of the conventional muffler configuration, without using an excessively increased internal muffler volume and a complex inner muffler construction. In this regard, a muffler having a simpler configuration may be designed. An example of such a simple muffler is illustrated in FIG. 7. In FIG. 7, the muffler is denoted by the reference numeral 20.

In FIG. 7, the reference numeral 21 denotes a reservoir having the form of an expansion chamber, 22 a first conduit which also serves as a muffler inlet, 23 a second conduit which also serves as a muffler outlet, and 100 a helicoil member.

As apparent from the above description, the present invention provides a muffler in which a helicoil member is installed in each conduit, through which refrigerant gas flows from or into an expansion chamber during reciprocating movements of a piston in a cylinder. The helicoil member has diverse twisted angles and diverse twisted shapes, and serves to divide pulsation of noise, generated during the reciprocating movements of the piston, into pulsation of different phases, and then to merge the divided pulsation together, while allowing the refrigerant gas to have the form of a vortex flow. As pulsation of noise generated during an operation of sucking refrigerant gas pass along different travel paths defined by the helicoil member, a mutual interference occurs between the pulsation respectively emerging from the travel paths of the helicoil member. Therefore, an increased offset effect for the pulsation of noise is obtained, which maximizes a noise attenuation effect. It is also possible to prevent refrigerant gas from flowing reversal due to a counter pressure gradient occurring during the reciprocating movements of the piston. Accordingly, enhanced compressor efficiency is obtained.

The noise attenuation also results in a reduction in the rate of heat energy generated in the expansion chamber. Accordingly, the specific volume of refrigerant gas is reduced, thereby achieving an improvement in compressor efficiency.

Moreover, the helicoil member of the present invention can be inexpensively manufactured. The installation of this helicoil member also can be easily and conveniently carried out. By virtue of the helicoil member, the muffler can have a considerably reduced size, as compared to those using no helicoil member. The helicoil member also makes it possible to achieve an easy manufacture of the muffler and an easy installation of the muffler in the interior of a compressor in which there are various geometrical limitations.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A muffler comprising:

a muffler inlet arranged in the muffler body, the muffler inlet communicating refrigerant lines extending into the interior of the casing;

a first reservoir defined, in the form of an expansion chamber, in the muffler body above the muffler inlet;

a second reservoir defined, in the form of an expansion chamber, in the muffler body beneath the first reservoir;

a first conduit having a reduced cross-sectional area, the first conduit serving to connect the first and second reservoirs to each other;

a second conduit having a reduced cross-sectional area, the second conduit serving to communicate the second reservoir with a muffler outlet provided at the muffler body;

a third reservoir defined, in the form of an expansion chamber, defined in the muffler body around the second conduit above the second reservoir, the third reservoir serving as the Helmholtz reservoir; and an interference member fixedly mounted in at least one of the first and second conduits.

2. The muffler according to claim 1, wherein the interference member comprises at least one helicoil foil fixedly mounted in an associated one of the first and second conduits to extend in a flowing direction of refrigerant gas in the associated conduit while being twisted by a desired twisted angle to form a spiral shape.

3. The muffler according to claim 2, wherein the at least one twisted helicoil foil comprises at least two helicoil foils arranged one after another in the flowing direction of refrigerant gas so that adjacent ones of the helicoil foils cross each other at facing ends thereof to form an angle of 90° between the facing ends.

4. The muffler according to claim 2, wherein the helicoil foil is made of a micro-porous material.

5. The muffler according to claim 2, wherein the twisted angle ranges from 90° to 360°.

6. The muffler according to claim 2, wherein the at least one helicoil foil comprises a plurality of helicoil foils combined together depending on a frequency of noise.

7. The muffler according to claim 2, wherein the helicoil foil is fixedly mounted in the second conduit.

8. The muffler according to claim 2, wherein the helicoil foil is fixedly mounted in each of the first and second conduits.

* * * * *